US008456501B2

(12) United States Patent
Okazaki et al.

(10) Patent No.: US 8,456,501 B2
(45) Date of Patent: Jun. 4, 2013

(54) EXPOSURE DEVICE AND IMAGE FORMING APPARATUS

(75) Inventors: Sachiya Okazaki, Mie (JP); Hideki Kataoka, Mie (JP)

(73) Assignee: Fuji Xerox Co., Ltd., Tokyo (JP)

( * ) Notice: Subject to any disclaimer, the term of this patent is extended or adjusted under 35 U.S.C. 154(b) by 38 days.

(21) Appl. No.: 13/185,076

(22) Filed: Jul. 18, 2011

(65) Prior Publication Data

US 2012/0194628 A1 Aug. 2, 2012

(30) Foreign Application Priority Data

Jan. 28, 2011 (JP) ..... 2011-016560

(51) Int. Cl.
*B41J 2/435* (2006.01)
*B41J 2/45* (2006.01)
*B41J 2/47* (2006.01)

(52) U.S. Cl.
USPC ..... 347/237; 347/238; 347/247

(58) Field of Classification Search
USPC ..... 347/237, 238, 247
See application file for complete search history.

(56) References Cited

U.S. PATENT DOCUMENTS 4,851,862 A * 7/1989 Newman et al. ..... 347/245
5,135,877 A * 8/1992 Albergo et al. ..... 438/29

FOREIGN PATENT DOCUMENTS

JP A-02-130477 5/1990
JP 2006237522 A * 9/2006
JP 2009096137 A * 5/2009
JP 2010284932 A * 12/2010

* cited by examiner

*Primary Examiner* — Hai C Pham
(74) *Attorney, Agent, or Firm* — Oliff & Berridge, PLC

(57) ABSTRACT

An exposure device includes a long board, plural light emitting elements arranged along a longitudinal direction of the board on one face of the board, plural inspection electrodes arranged along the longitudinal direction of the board on the other face of the board, and plural electrical wirings each electrically connects between one of the plural light emitting elements and one of the plural inspection electrodes that is not positioned nearest to the one of the plural light emitting elements.

7 Claims, 7 Drawing Sheets

EXPOSURE DEVICE AND IMAGE FORMING APPARATUS

CROSS-REFERENCE TO RELATED APPLICATIONS

This application is based on and claims priority under 35 USC 119 from Japanese Patent Application No. 2011-016560 filed Jan. 28, 2011.

BACKGROUND

Technical Field

The present invention relates to an exposure device and an image forming apparatus.

SUMMARY

According to an aspect of the invention, there is provided an exposure device including a long board, plural light emitting elements arranged along a longitudinal direction of the board on one face of the board, plural inspection electrodes arranged along the longitudinal direction of the board on the other face of the board, and plural electrical wirings each electrically connects between one of the plural light emitting elements and one of the plural inspection electrodes that is not positioned nearest to the one of the plural light emitting elements.

BRIEF DESCRIPTION OF THE DRAWINGS

Exemplary embodiments of the present invention will be described in detail based on the following figures, wherein.

DETAILED DESCRIPTION

An exemplary embodiment of an exposure device and an image forming apparatus related to the invention will be described below with reference to the accompanying drawings.

(Overall Configuration)

Figure 1:
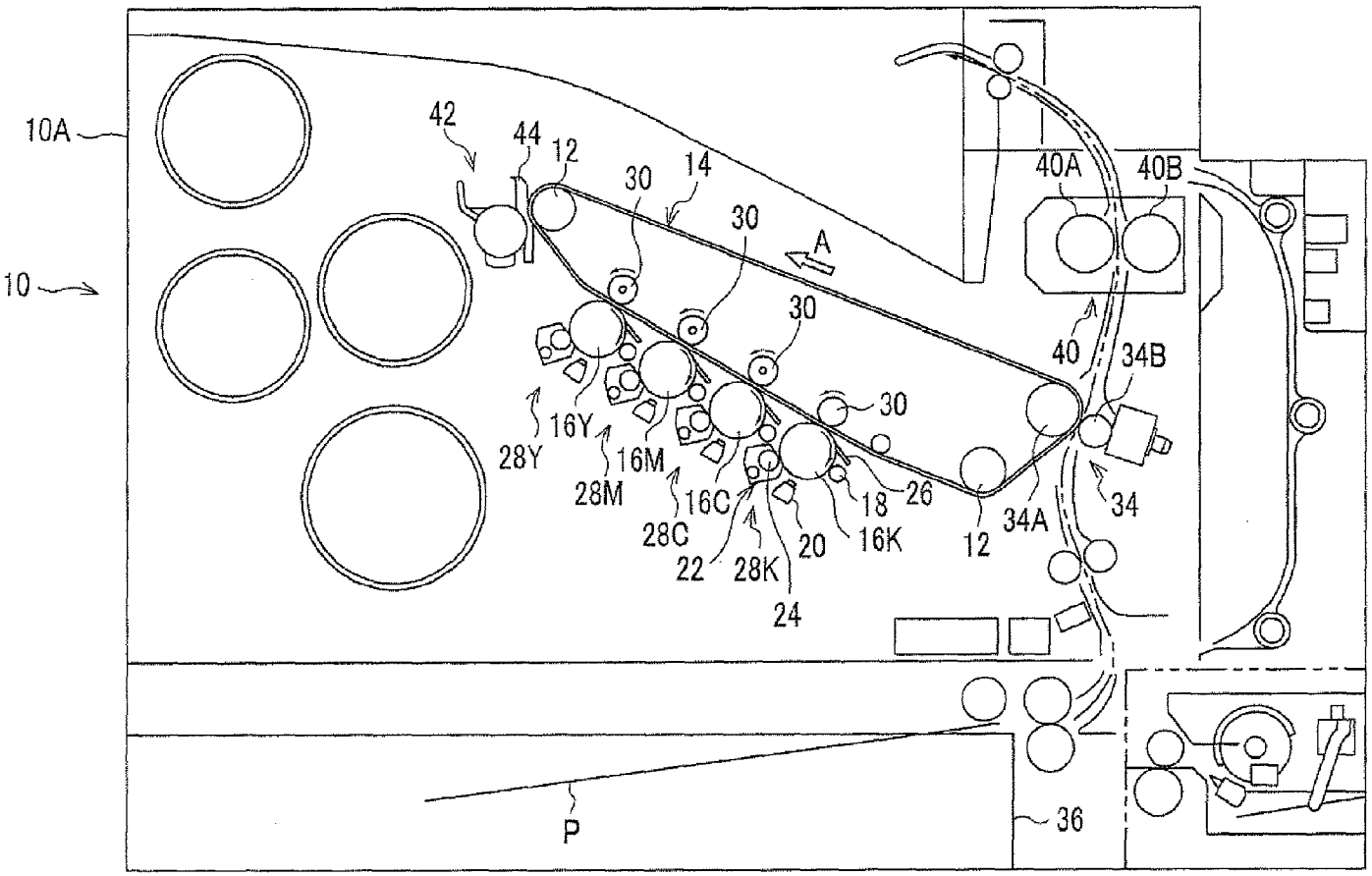
FIG. 1 is an overall configuration view showing the configuration of an image forming apparatus related to an exemplary embodiment of the invention overall.

FIG. 1 shows an example of the configuration of an image forming apparatus that has an exposure device related to the exemplary embodiment of the invention.

As shown in FIG. 1, an apparatus body 10A of an image forming apparatus 10 is provided with an intermediate transfer body belt 14 serving as an example of an endless belt-shaped body to be transferred, which is stretched over plural rollers 12 and conveyed in the direction of an arrow A by the driving of a motor (not shown).

The image forming apparatus 10 supports formation of a color image, and has image forming units 28Y, 28M, 28C, and 28K that form toner images corresponding to four colors of yellow (Y), magenta (M), cyan (C), and black (K). The image forming units 28Y, 28M, 28C, and 28K are arranged along the longitudinal direction of the intermediate transfer body belt 14, and are detachably supported by the apparatus body 10A.

In addition, members provided for the respective colors are designated by adding letters (Y/M/C/K) indicating the colors to the ends of reference numerals, respectively. Particularly when description is made without distinguishing the colors, the letters at the ends of the reference numerals are omitted.

The image forming units 28Y, 28M, 28C, and 28K respectively include photoreceptor drums 16Y, 16M, 16C, and 16K serving as examples of image carriers that are rotated in the clockwise direction by a driving unit composed of a motor and gears that are not shown.

A charging roller 18 for uniformly charging a surface of the photoreceptor drum 16 with given potential is arranged at a peripheral surface of each photoreceptor drum 16. The charging roller 18 is a conductive roller, and a peripheral surface thereof comes into contact with the peripheral surface of the photoreceptor drum 16. The charging roller 18 is arranged such that the axis direction of the charging roller 18 and the axis direction of the photoreceptor drum 16 become parallel to each other.

An LED print head (hereinafter referred to as "LPH") 20 serving as an example of an exposure device is arranged at the peripheral surface of each photoreceptor drum 16 on the downstream side of the charging roller 18 in the rotational direction of the photoreceptor drum. The LPH 20 is long, and is arranged along the axial direction of the photoreceptor drum 16. The LPH 20 has an LED (light-emitting diode) array serving as an example of a light emitting element, as a light source. The LPH 20 irradiates the photoreceptor drum 16 with light beams according to image data, thereby forming an electrostatic latent image on the surface of the photoreceptor drum 16. The LPH 20 will be described below in detail.

A developing device 22 is arranged at the peripheral surface of each photoreceptor drum 16 on the downstream side of the LPH 20 in the rotational direction of the photoreceptor drum. The developing device 22 is provided to develop the electrostatic latent image formed on the surface of the photoreceptor drum 16 with a toner for each color (yellow/magenta/cyan/black) so as to form a toner image.

Specifically, the developing device 22 has a cylindrical developing roller 24 that is arranged in close proximity to the photoreceptor drum 16, and is rotatably provided. A development bias is applied to the developing roller 24, and a toner loaded into the developing device 22 is adhered to a peripheral surface of the developing roller. By the rotation of the developing roller 24, the toner adhered to the developing roller 24 is conveyed to the surface of the photoreceptor drum 16, the toner is rubbed against the photoreceptor drum 16, and the electrostatic latent image formed on the surface of the photoreceptor drum 16 is developed as a toner image.

A transfer roller 30 serving as an example of a transfer device that transfers the toner image on each photoreceptor drum 16 to the intermediate transfer body belt 14 is provided at the peripheral surface of each photoreceptor drum 16 on the downstream side of the developing device 22 in the rotational direction of the photoreceptor drum. The transfer roller 30 is charged with a given potential and rotated counterclockwise to convey the intermediate transfer body belt 14 at a given speed and presses the intermediate transfer body belt 14 against the photoreceptor drum 16. Thereby, the toner image on the surface of the photoreceptor drum 16 is transferred onto the intermediate transfer body belt 14.

A cleaning blade 26 is arranged on the peripheral surface of each photoreceptor drum 16 on the downstream side of the transfer roller 30. The cleaning blade 26 is disposed such that one end thereof comes into contact with the surface of the photoreceptor drum 16, and recovers the toner remaining on the photoreceptor drum 16 without being transferred to the intermediate transfer body belt 14, and scrapes off and recovers other color toners that have adhered onto the photoreceptor drum 16 at the time of transfer.

The respective toner images formed by the respective image forming units 28 are transferred so as to overlap each other on a belt surface of the intermediate transfer body belt 14. Thereby, a color toner image is formed on the intermediate transfer body belt 14. Hereinafter, a toner image to which four color toner images are transferred in an overlapping manner is referred to as a "final toner image".

A secondary transfer device 34 configured to include two facing rollers 34A and 343 is disposed on the downstream side of the four photoreceptor drums 16 in the conveying direction of the intermediate transfer body belt 14. In the secondary transfer device 34, the final toner image formed on the intermediate transfer body belt 14 is transferred to a recording paper P that has been taken out from a paper tray 36 provided at the bottom of the image forming apparatus 10 and has been conveyed to between the rollers 34A and 34B.

A fixing device 40 configured to include a heating roller 40A and a pressurizing roller 40B is disposed at a conveying path for the recording paper P to which the final toner image has been transferred. The recording paper P conveyed to the fixing device 40 is conveyed while pinched between the heating roller 40A and the pressurizing roller 40B. Thereby, the toner on the recording paper P is melted, is brought into pressure contact with the recording paper 2, and is fixed on the recording paper P.

On the other hand, in an outer peripheral surface of the intermediate transfer body belt 14, a cleaning device 42 that recovers the toner remaining on the intermediate transfer body belt 14 without being transferred to the recording paper P by the secondary transfer device 34 is disposed on the downstream side of the secondary transfer device 34 in the conveying direction of the intermediate transfer body belt 14. The cleaning device 42 has a blade 44 that comes into contact with the intermediate transfer body belt 14, and rubs off the toner remaining on the intermediate transfer body belt 14 to recover the toner.

In the image forming apparatus 10 configured as above, an image is formed as follows.

First, the surface of the photoreceptor drum 16 is uniformly negatively-charged by the charging roller 18. Next, exposure is performed on the surface of the charged photoreceptor drum 16, on the basis of image data to be printed by the LHP 20, and an electrostatic latent image is formed on the surface of the photoreceptor drum 16.

Next, when the electrostatic latent image of the photoreceptor drum 16 surface passes by the developing roller of the developing device 22, a toner adheres to the electrostatic latent image due to an electrostatic force, whereby the electrostatic latent image is visualized as a toner image.

Next, respective visualized color toner images are sequentially transferred to the intermediate transfer body belt 14 by the transfer rollers 30, and a final toner image is formed in color on the intermediate transfer body belt 14.

Next, the final toner image on the intermediate transfer body belt 14 is sent to between the rollers 34A and 34B of the secondary transfer device 34, and the final toner image is transferred to the recording paper P that is taken out from the paper tray 36, and similarly conveyed to between the rollers 34A and 34B.

Next, the toner image transferred to the recording paper P is fixed as a permanent image by the fixing device 40. The recording paper P that has passed through the fixing device 40 is ejected to the outside of the apparatus.

(Configuration of LPH 20)

Next, the LPH 20 will be described in detail.

Figure 2:
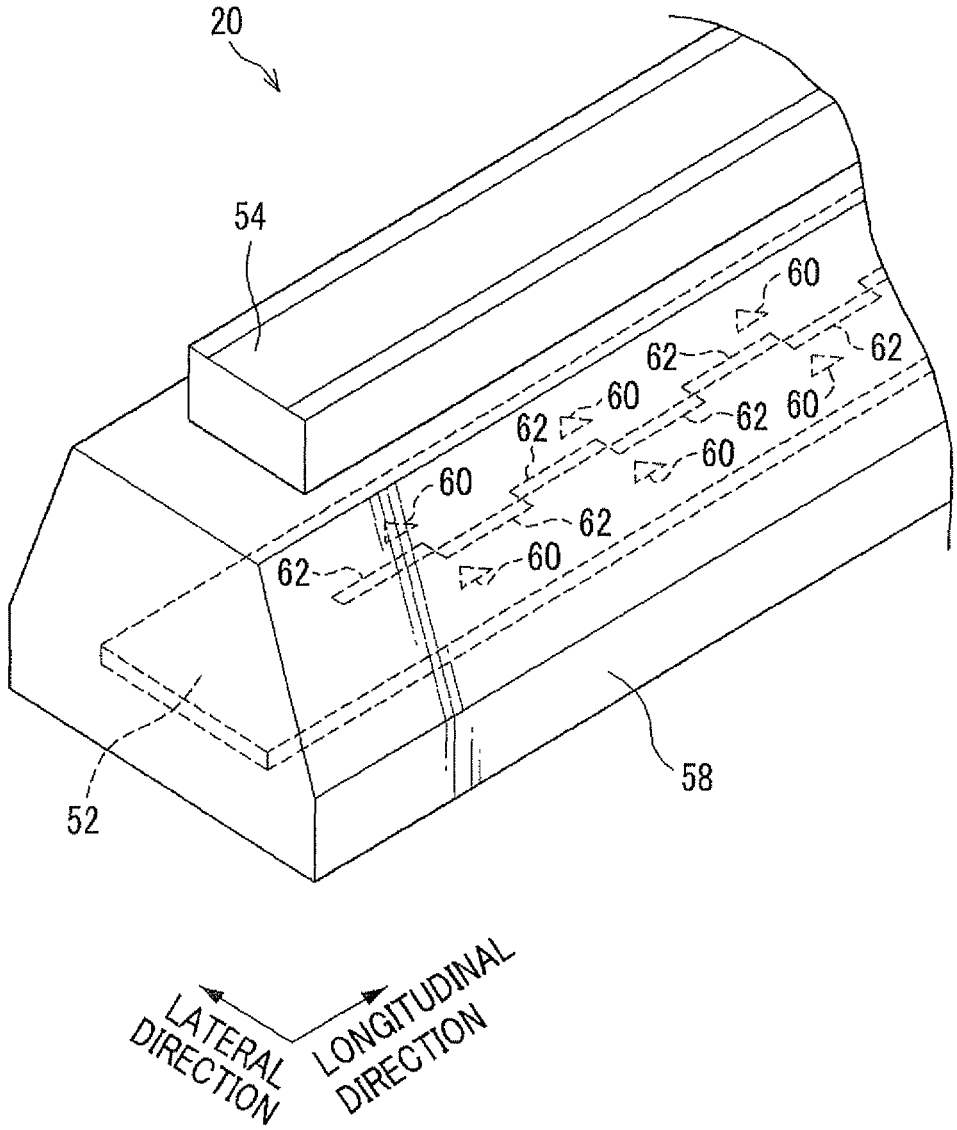
FIG. 2 is a perspective view of an exposure device shown in FIG. 1.
Figure 3:
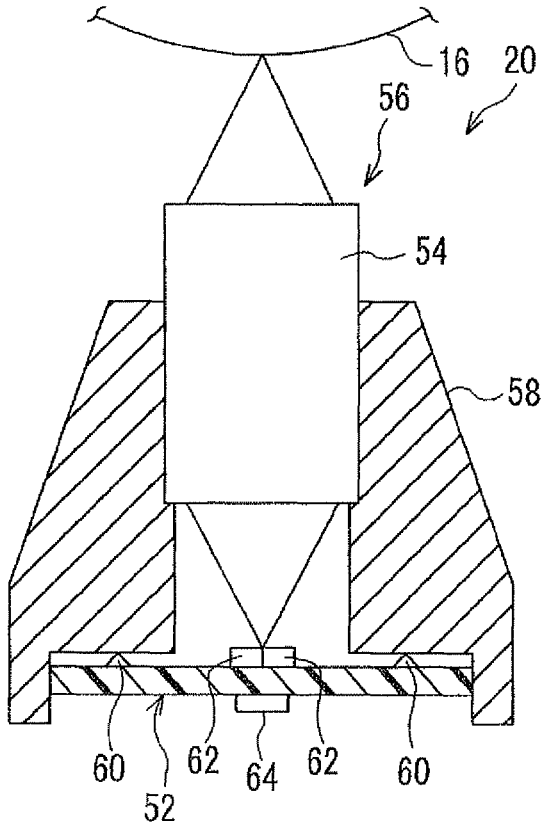
FIG. 3 is a cross-sectional view of the exposure device shown in FIG. 1.
Figure 4:
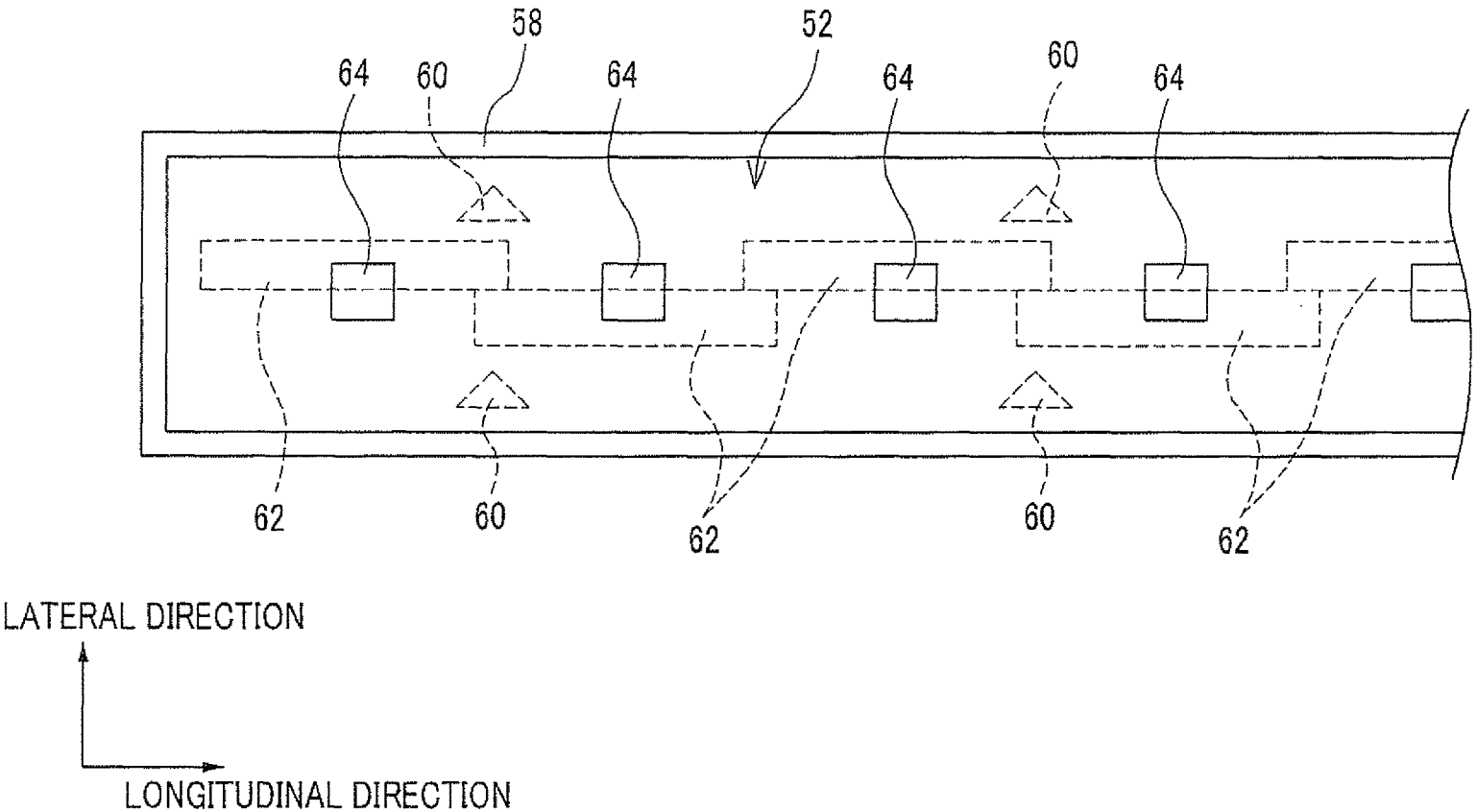
FIG. 4 is a bottom view of the exposure device shown in FIG. 1.

As shown in FIGS. 2, 3, and 4, the LPH 20 includes a printed wiring board 52 as an example of a board, a lens array 54 arranged so as to face the printed wiring board 52, and a housing 58 that houses the printed wiring board 52 and the lens array 54.

The printed wiring board 52 has a long plate shape, and plural (specifically, twenty) LED arrays 62 are alternately arranged along the longitudinal direction of the printed wiring board 52 on a top face of the printed wiring board 52. Although not shown, plural (specifically, 256) light emitting points composed of LEDs are arranged in one row along the longitudinal direction at each LED array 62. Each LED array 62 radiates a light beam toward the lens array 54.

The lens array 54 is pinched and fixed to the housing 58 above the printed wiring board 52, and the light beam radiated from each LED array 62 is focused on the surface of the photoreceptor drum 16.

The printed wiring board 52 is attached to the housing 58 by adhesive members (adhesive) 60 (schematically shown in a triangular shape in the drawing) serving as an example of a fixing section. The adhesive members 60 are arranged in pairs with the LED arrays 62 therebetween on the top face of the printed wiring board 52, and are provided in plural places so as to be dotted along the longitudinal direction of the printed wiring board 52. In addition, the fixing section is not limited to the adhesive members 60, and may be configured, for example, by an engaging claw provided on the housing 58, and an engaging hole having the engaging claw inserted thereinto and engaged therewith, and provided in the printed wiring board 52.

As shown in FIGS. 3 and 4, plural inspection electrodes 64 are arranged along the longitudinal direction of the printed wiring board 52 on a bottom face of the printed wiring board 52. The same number of (twenty) inspection electrodes 64 as the LED arrays 62 are provided, and each inspection electrode 64 is arranged so as to correspond to a central portion of each LED array 62 in the longitudinal direction thereof. That is, each inspection electrode 64 is arranged at a position that faces each LED array 62 with the printed wiring board 52 therebetween. The inspection electrodes 64 are electrodes (test pads) used in light emission inspection of the LED arrays 62. In addition, the inspection electrodes 64 are very thin because the inspection electrodes are formed using metallic foils, such as the same copper foil as a circuit pattern (not shown) of the printed wiring board 52. However, the inspection electrodes are shown thickly in FIGS. 3, and 5 to 7 in order to make description easily understood.

(Light Emission Inspection)

Figure 5:
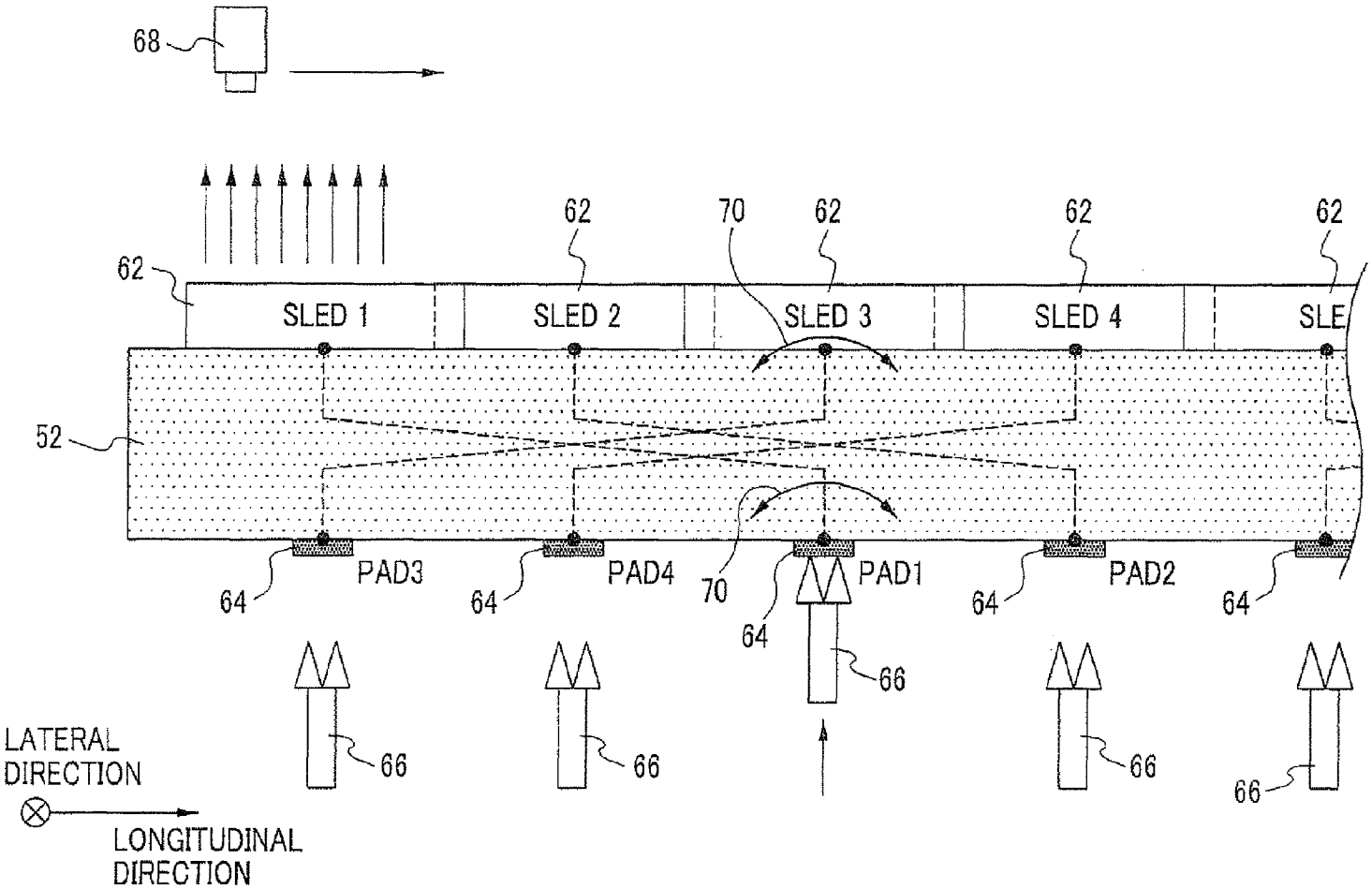
FIG. 5 is a side view when a printed wiring board shown in FIG. 2 is seen from its lateral direction, and is an explanatory view showing an aspect when LED arrays are inspected.

Light emission inspection will be described below. FIG. 5 is a side view when the printed wiring board 52 is seen from its lateral direction, showing an aspect in regard to light emission inspection of the LED arrays 62. In the light emission inspection, inspection probes 66 are sequentially pressed against the inspection electrodes 64, the electric power for making the LED arrays 62 emit light is supplied to the electrodes, and a control signal for making each LED array 62 actually emit light is transmitted. Then, a CCD camera 68 is arranged above the LED arrays 62 to perform scanning (movement) in the longitudinal direction, and sequentially performs the light emission inspection of the LED arrays 62 one by one from one end side (the left side in FIG. 5). The light emission inspection is to confirm the presence of light emission of 256 light emitting points of each LED array, the light emission intensity when a given current is made to flow, the light emission positions of the respective light emitting points, and the like. In addition, the plural inspection probes 66 are provided so as to correspond to the inspection electrodes 64, respectively. Additionally, illustration of the lens array 54 and the housing 58 is omitted in FIG. 5, and actual light emission inspection is performed on a finished product of the LPH 20 that is assembled and finished.

Here, in the printed wiring board 52, a first LED array 62 (shown as "SLED1" in the drawing) from the left in the drawing is connected to the inspection electrode 64 (shown as "PAD1" in the drawing) arranged directly below a third LED array 62 (shown as "SLED3" in the drawing). Additionally, a second LED array 62 (shown as "SLED2" in the drawing) is connected to the inspection electrode 64 (shown as "PGD2" in the drawing) arranged directly below a fourth LED array 62 (shown as "SLED4" in the drawing). Additionally, the third LED array 62 (shown as "SLED3" in the drawing) is connected to the inspection electrode 64 (shown as "PAD3" in the drawing) arranged directly below the first LED array 62 (shown as "SLED1" in the drawing). Additionally, the fourth LED array 62 (shown as "SLED4" in the drawing) is connected to the inspection electrode 64 (shown as "PAD4" in the drawing) arranged directly below the second LED array 62 (shown as "SLED2" in the drawing). After that, the same is true on fifth to eighth LED arrays 62 and the inspection electrodes 64, ninth to twelfth LED arrays 62 and the inspection electrodes 64, thirteenth to sixteenth LED arrays 62 and the inspection electrodes 64, and seventeenth to twentieth LED arrays 62 and the inspection electrodes 64. In addition, SLED is short for Self Scanning Light Emitting Diode.

In this way, in the printed wiring board 52, each LED array 62 is connected to the inspection electrode 64 that is not arranged directly therebelow. Only the inspection probe corresponding to the inspection electrode 64 (PAD1) connected to the first LED array 62 among the plural inspection probes 66 is pressed against the inspection electrode 64 (PAD1). Next, only the inspection probe 66 corresponding to the inspection electrode 64 (PAD2) connected to the second LED array 62 among the plural inspection probes 66 is pressed against the inspection electrode 64 (PAD2). Thereafter, similarly, the inspection probes 66 to be pressed are sequentially switched up to the inspection probe 66 corresponding to the twentieth LED array 62. Thereby, the first LED array 62 to the twentieth LED array 62 emit light sequentially. Scanning of the CCD camera 68 is performed from the first LED array 62 toward the twentieth LED array 62 and light emission inspection of all the LED arrays 62 is performed, so as to interlock with this sequential light emission.

Figure 6:
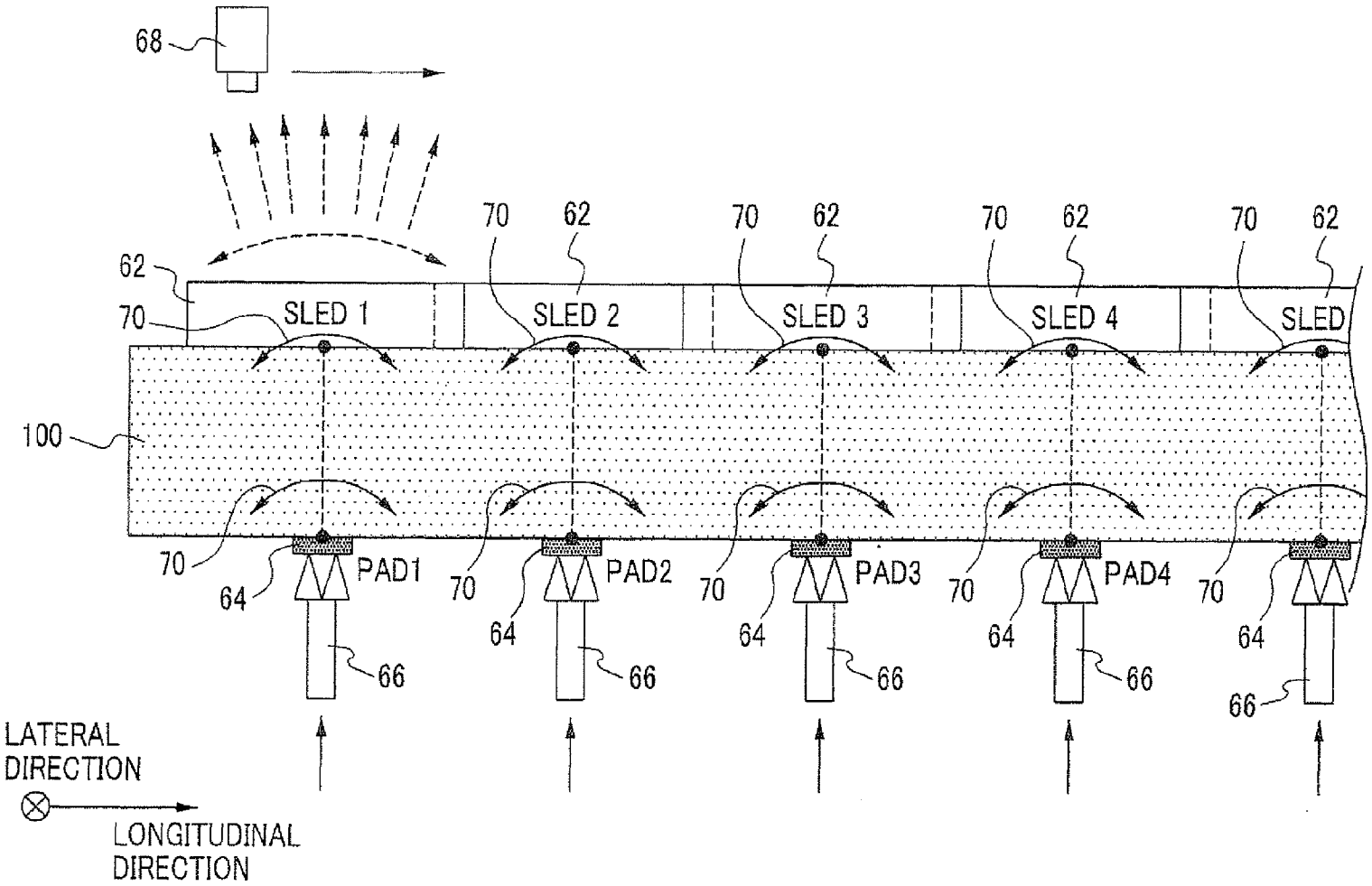
FIG. 6 is an explanatory view showing an aspect when the LED arrays are inspected, which is shown as a comparative example of FIG. 5.

FIG. 6 shows an aspect of light emission inspection shown as a comparative example in respect to FIG. 5. In a printed wiring board 100 shown in FIG. 6, each LED array 62 is connected to the inspection electrode 64 arranged directly therebelow as shown. Additionally, at the time of light emission inspection, the plural inspection probes 66 are all pressed against the inspection electrodes 64 simultaneously. On the basis of such a configuration, control signals for making the first to twentieth LED arrays 62 emit light sequentially are transmitted to the respective LED arrays 62 through the respective inspection probes 66, and the first to twentieth LED arrays 62 are made to emit light sequentially. Then, scanning of the CCD camera 68 is performed from the first LED array 62 toward the twentieth LED array 62, thereby performing the light emission inspection of all the LED arrays 62.

In the printed wiring board 100 of the comparative example shown in FIG. 6, each LED array 62 is connected to the inspection electrode 64 arranged directly therebelow. Thus, strain 70 of the printed wiring board 100 originating from a pressing force pressed by the inspection probe 66 will exert an influence on each LED array 62 to be subjected to the light emission inspection. That is, the light emission inspection is performed in the state where the strain 70 exerts an influence on the LED array 62 to be subjected to the light emission inspection, and an optical axis of the light emitting points of the LED array 62 deviates, so that the light emission inspection may not be performed with high precision. In addition, if the pressure that the inspection probe 66 applies is made small, poor contact occurs between the inspection probe and the inspection electrodes 64, which causes poor inspection. Additionally, in the comparative example shown in FIG. 6, even if the plural inspection probes 66 are pushed against the inspection electrodes 64 sequentially at the time of light emission inspection, the strain 70 of the printed wiring board 100 originating from the pressing force pressed by the inspection probe 66 exerts an influence on the LED array 62 to be subjected to the light emission inspection. This is because each LED array 62 is connected to the inspection electrode 64 arranged directly therebelow.

In contrast, in the light emission inspection in the present exemplary embodiment shown in FIG. 5, each LED array 62 is connected to the inspection electrode 64 that is not arranged directly therebelow, and the inspection probes 66 are pressed against the inspection electrodes 64 sequentially. Thus, the strain 70 of the printed wiring board 52 resulting from the pressing force of the inspection probe 66 does not easily exert an influence on the LED array 62 to be subjected to the light emission inspection. Accordingly, deviation of the optical axis of the light emitting points of the LED array 62 to be subjected to the light emission inspection may be suppressed, and the light emission inspection may be performed with high precision.

Figure 7:
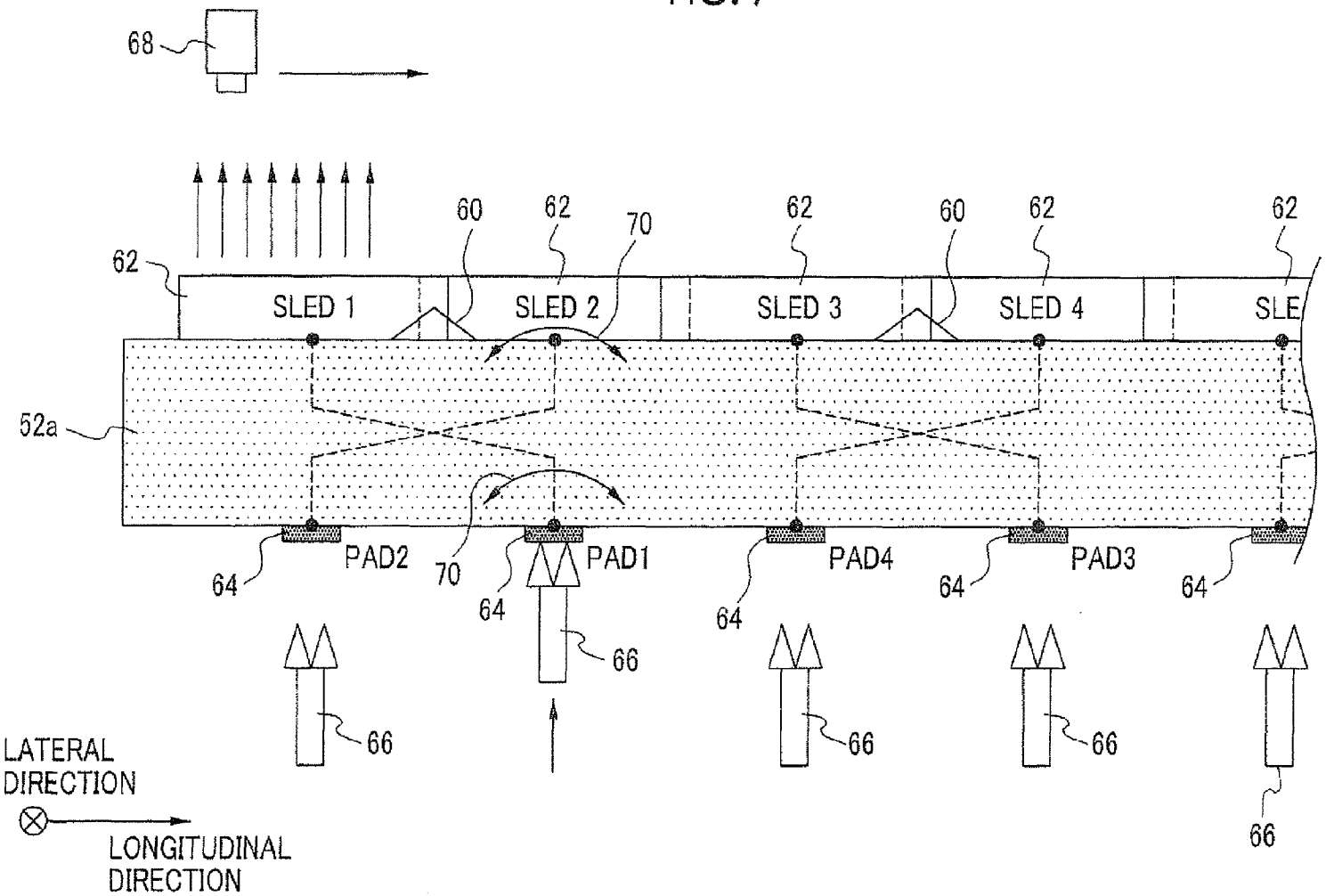
FIG. 7 is an explanatory view similar to FIG. 5, showing another aspect of the printed wiring board of FIG. 5.

FIG. 7 shows a modification aspect of the printed wiring board 52 in the present exemplary embodiment shown in FIG. 5. Here, in a printed wiring board 52*a* shown in FIG. 7, a first LED array 62 (SLED1) from the left in the drawing is connected to the inspection electrode 64 (PAD1) arranged directly below a second LED array 62 (SLED2). Additionally, the second LED array 62 (SLED2) is connected to the inspection electrode 64 (PAD2) arranged directly below the first LED array 62 (SLED1). The same is true of the third to fourth LED arrays 62 and the inspection electrodes 64, fifth to sixth LED arrays 62 and the inspection electrodes 64, . . . , and nineteenth to twentieth LED arrays 62 and the inspection electrodes 64. That is, each LED array 62 is connected to the inspection electrode 64 arranged directly below its adjacent LED array 62.

Additionally, in FIG. 7, when description is made including the arrangement relationship of the plural dotted adhesive members 60 mentioned above, the adhesive members 60 are respectively arranged so as to be interposed between the first LED array 62 (SLED1) and the second LED array 62 (SLED2), between the third LED array 62 (SLED3) and the fourth LED array 62 (SLED4), . . . , and between the nineteenth LED array 62 and the twentieth LED array 62, in side view shown in FIG. 7.

Here, for example, in a case where each LED array 62 is connected to the inspection electrode 64 arranged directly below its adjacent LED array 62, and the adhesive member 60 is not interposed between its adjacent LED array 62, the same effects as the exemplary embodiment described with reference to FIG. 5 may be obtained. However, there is a case in which a higher-precision light emission inspection may be required, such as a case where a high-precision image is formed.

Thus, in the printed wiring board 52*a*, although each LED array 62 is connected to the inspection electrode 64 arranged directly below its adjacent LED array 62, the LED array is connected to the inspection electrode 64 at a position over the adhesive member 60. Since the arrangement point of the adhesive member 60 is considered as a fixed end, the strain 70 does not easily exert an influence on the LED array 62 to be subjected to the light emission inspection. Accordingly, even if each LED array 62 is connected to the inspection electrode 64 arranged directly below its adjacent LED array 62, the light emission inspection may be performed with high precision. Additionally, in the printed wiring board 52*a*, each LED array 62 is connected to the inspection electrode 64 arranged directly below its adjacent LED array 62. Thus, a wiring path that connects the LED array 62 and the inspection electrode 64 is shortened compared to the printed wiring board 52 shown in FIG. 5.

In addition, although the plural LED arrays 62 have been alternately arranged in the LPH 20 related to the present exemplary embodiment, the LED arrays may simply be arranged linearly in one row. Additionally, although the above-described exemplary embodiment shows that there are 20 LED arrays 62 and there are 256 light emitting points of each LED array 62, the invention is not meant to be limited to these numbers.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An exposure device comprising:

a board;

a plurality of light emitting element arrays arranged along a longitudinal direction of the board on one face of the board;

a plurality of inspection electrodes arranged along the longitudinal direction of the board on the other face of the board; and a plurality of electrical wirings each electrically connects between one of the plurality of light emitting element arrays and one of the plurality of inspection electrodes that is not positioned nearest to the one of the plurality of light emitting element arrays.

2. The exposure device according to claim 1, further comprising:

a housing that houses the board, and a plurality of fixing sections provided along a longitudinal direction of the board to fix the board with the housing, wherein each of the plurality of wiring that connects between the one of the plurality of light emitting elements and the one of plurality of inspection electrodes is arranged over at least one of the plurality of fixing sections.

3. The exposure device according to claim 1, wherein a length of the light emitting element array along the longitudinal direction of the board is longer than a length of the inspection electrode along the longitudinal direction of the board and each of the plurality of inspection electrodes is arranged within a range of the length of the light emitting element array along the longitudinal direction of the board.

4. The exposure device according to claim 1, wherein the inspection electrode is pressed by an inspection probe that supplies current to the light emitting element array.

5. The exposure device according to claim 1, wherein the plurality of light emitting element arrays are arranged in a line on the board along the longitudinal direction of the board.

6. The exposure device according to claim 1, wherein the plurality of light emitting element arrays are arranged alternately across a line on the board along the longitudinal direction of the board.

7. An image forming apparatus comprising:

the exposure device according to claim 1;

an image carrier exposed by the exposure device and having an electrostatic latent image formed thereon;

a developing device that develops the electrostatic latent image formed on the image carrier with a toner; and a transfer device that transfers a toner image developed by the developing device on a body to be transferred.

* * * * *